United States Patent [19]

La Borde

[11] 3,992,839

[45] Nov. 23, 1976

[54] SNAP-ON PANELING

[75] Inventor: Joseph N. La Borde, Baton Rouge, La.

[73] Assignee: Ethyl Corporation, Richmond, Va.

[22] Filed: June 19, 1975

[21] Appl. No.: 588,326

Related U.S. Application Data

[63] Continuation of Ser. No. 525,960, Nov. 21, 1974, abandoned, which is a continuation of Ser. No. 366,585, June 4, 1973, abandoned.

[52] U.S. Cl. ..... 52/275; 52/282; 52/570; 52/588; 52/594; 52/619

[51] Int. Cl.[2] ..... E04L 2/32

[58] Field of Search ..... 52/284, 288, 493, 570, 52/588, 593, 594, 595, 275, 282, 577, 619, 731, 309; 46/25, 26

[56] References Cited

UNITED STATES PATENTS

| | | | |
|---|---|---|---|
| 2,257,001 | 9/1941 | Davis | 52/593 |
| 3,136,395 | 6/1964 | Rebele | 52/731 |
| 3,191,988 | 6/1965 | Sturtevant et al. | 52/400 |
| 3,290,823 | 12/1966 | Okumoto | 52/619 X |
| 3,562,992 | 2/1971 | Kinsey | 52/588 |
| 3,727,363 | 4/1973 | Kinsey | 52/731 |

FOREIGN PATENTS OR APPLICATIONS

| | | | |
|---|---|---|---|
| 1,270,331 | 6/1968 | Germany | 52/588 |
| 458,297 | 7/1950 | Italy | 52/570 |
| 1,229,921 | 4/1971 | United Kingdom | 52/595 |

*Primary Examiner*—Alfred C. Perham
*Attorney, Agent, or Firm*—Donald L. Johnson; John F. Sieberth; Paul H. Leonard

[57] ABSTRACT

Snap-together paneling for use in making walls and corners in the building industry. The paneling includes two inverted wall panels which when snapped together form an inverted wall assembly, and two everted wall panels which when snapped together form an everted wall assembly. The everted wall assembly and inverted wall assembly slidably and lockedly connect together to form a wall. Corner covers are used for forming a corner from the wall assemblies and end covers are used for covering the end of an exposed wall assembly.

9 Claims, 9 Drawing Figures

SNAP-ON PANELING

This is a continuation of application Ser. No. 525,960, filed on Nov. 21, 1974, now abandoned, which in turn is a continuation of application Ser. No. 366,585, filed on June 4, 1973, now abandoned.

BACKGROUND OF THE INVENTION

The invention relates to the construction of buildings and in particular to the construction of walls.

The cost of construction of buildings or dwellings is rapidly increasing. Material costs are generally increasing as is the price of labor employed in construction. The cost of a family dwelling has risen so drastically that it is extremely difficult, and sometimes impossible, for the average American family to purchase a suitable dwelling. It is therefore highly desirable that the cost of construction be decreased or minimized.

THE INVENTION

In accordance with the present invention there is provided low cost, rigid, snap-together paneling. The paneling includes an inverted panel assembly and an everted panel assembly, the side of the everted panel assembly having a projection means formed thereon adapted to be received and held within a channel or opening provided within the inverted panel assembly. Both the inverted panel assembly and the everted panel assembly include two panel sections which snap together to form the everted or inverted panel assembly. An end cover is provided for the inverted panel assembly and a corner cover is provided for joining two panel assemblies to form a corner.

Figure 1:
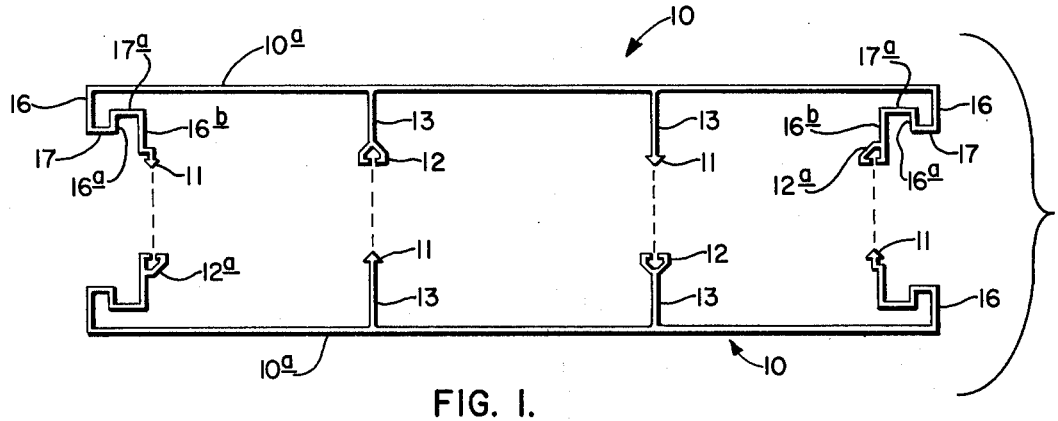
Figure 1A:
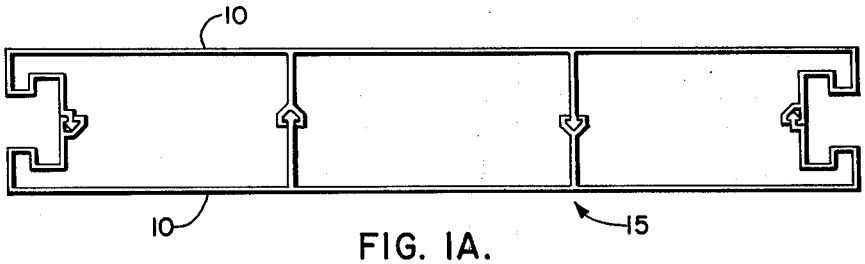
Figure 2:
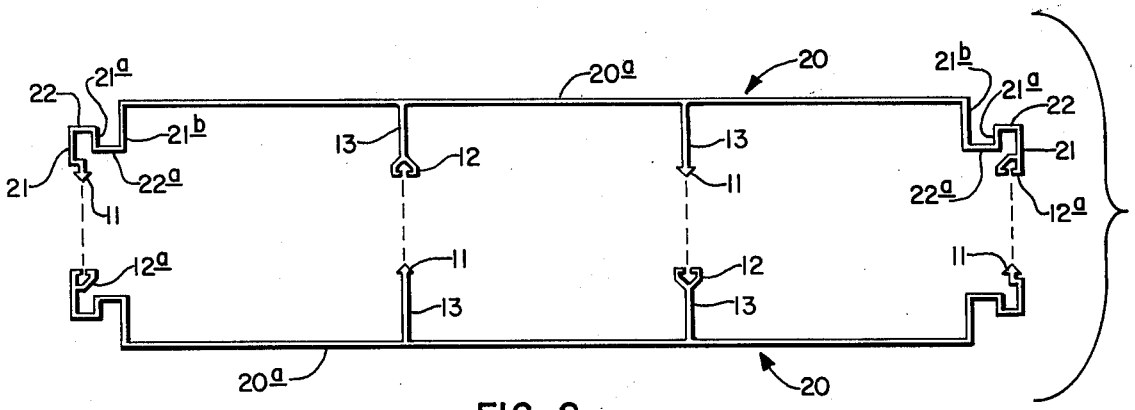
Figure 2A:
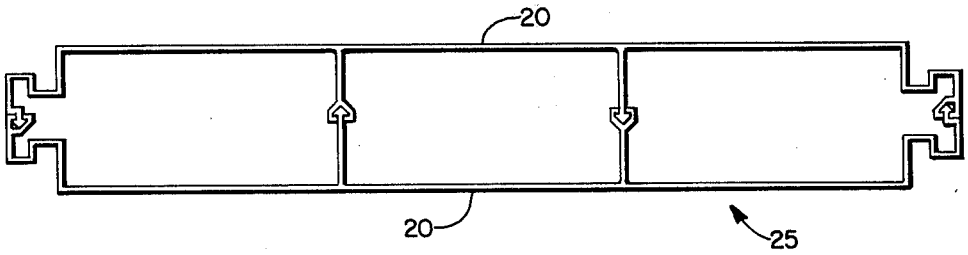
Figure 4:
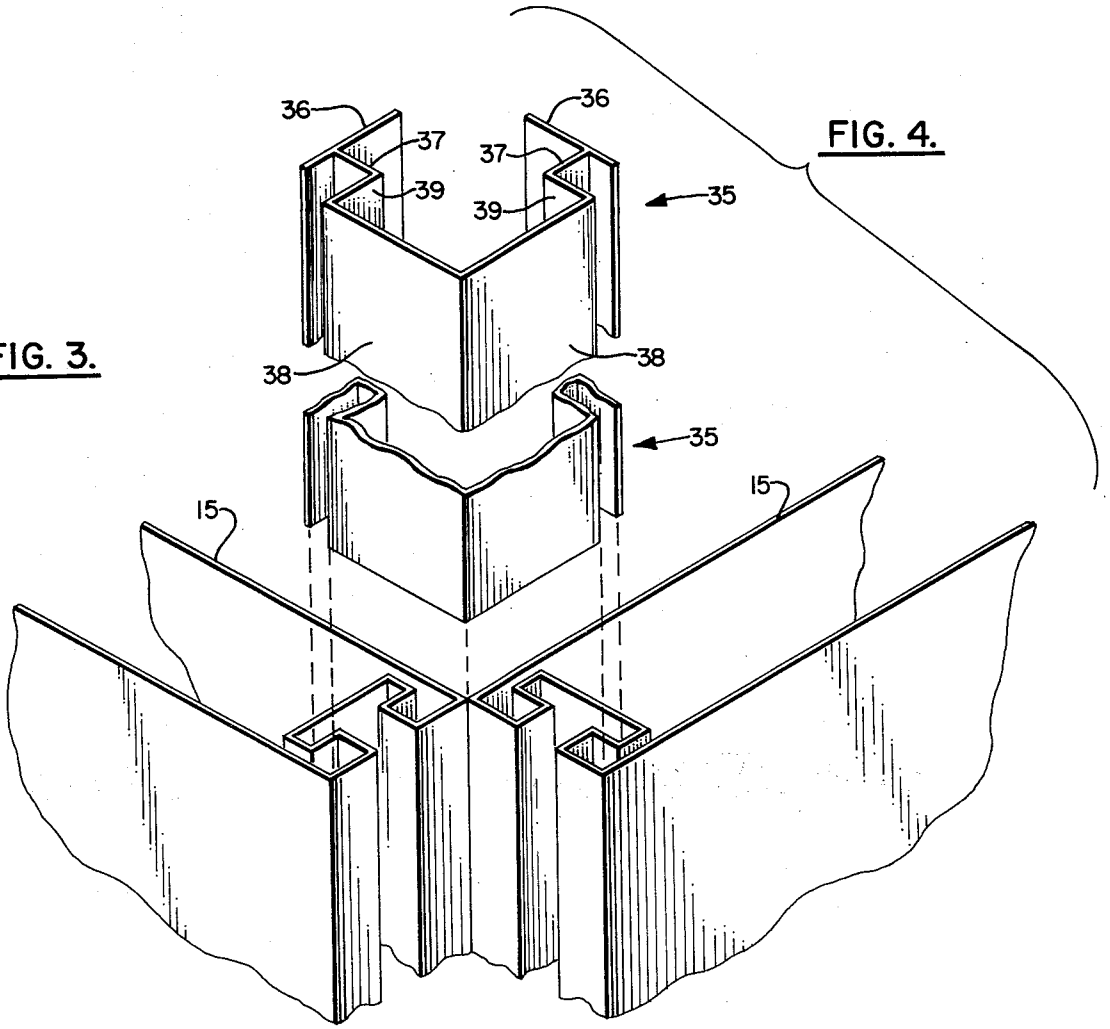
Figure 3:
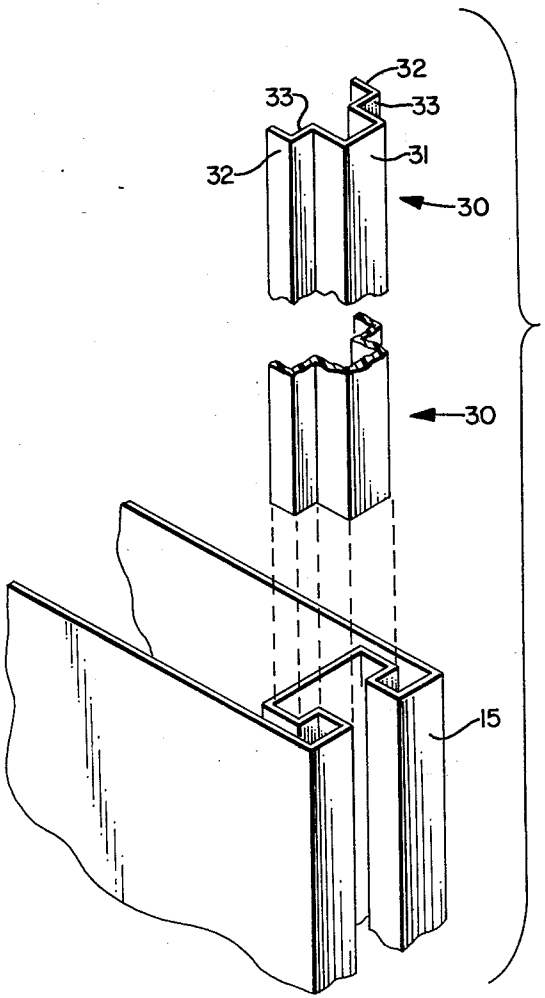
Figure 7:
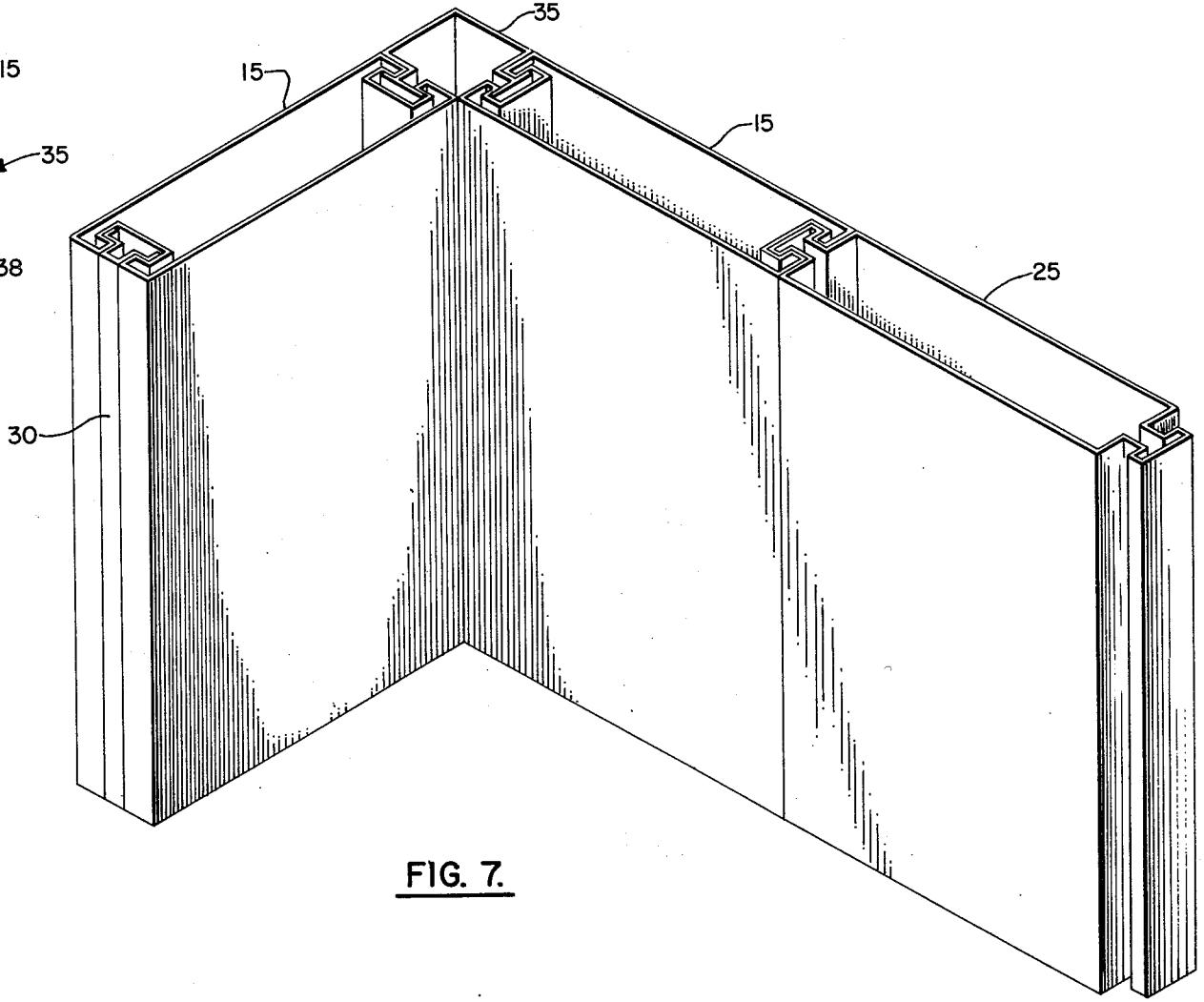
Figure 5:
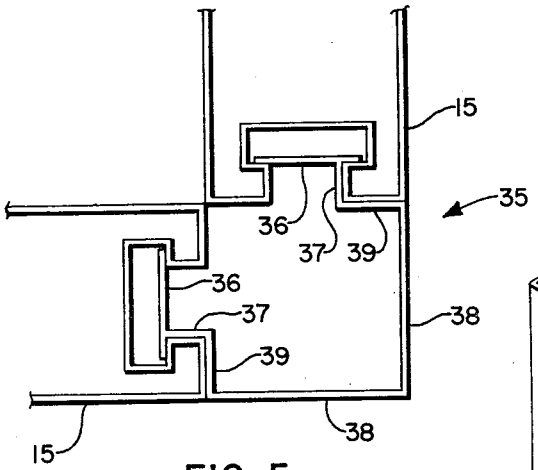
Figure 6:
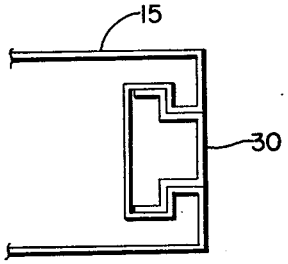

The invention will be more fully understood by reference to the drawings in which:

FIG. 1 — is a top plan view of two unassembled inverted panels aligned for assembly;

FIG. 1*a* — is a top plan view of two assembled inverted panels;

FIG. 2 — is a top plan view of two unassembled everted panels aligned for assembly;

FIG. 2*a* — is a top plan view of two assembled everted panels;

FIG. 3 — is a perspective cutaway view of an end cover aligned for connection with an inverted wall assembly;

FIG. 4 — is a perspective cutaway view of a corner cover aligned for connection with two inverted wall assemblies;

FIG. 5 — is a top plan view of a corner cover connected to two inverted wall assemblies;

FIG. 6 — is a top plan view of an inverted wall assembly having an end cover connected thereto; and FIG. 7 — is a perspective view of two walls and a corner made in accordance with the present invention.

Referring now to the drawings, in FIG. 1 is shown two inverted panels, indicated generally by the numeral 10, aligned for assembly. Both panels are identical, but one panel has been turned 180° relative to the other panel so that the panels may be clipped together. The panels are held together by male connectors 11 and female connectors 12. The male connector 11 has a generally diamond-shaped head mounted on the end of a support 13 connected to panel 10, as shown in FIG. 1. The female connectors have a channel therein and are mounted on the end of support 13. The number of supports 13 required is optional and may vary according to the width of the panel. If the panels are relatively narrow, supports 13 may be eliminated as shown in FIG. 7. The channel is adapted to slidingly receive male connector 11 and snap thereon. Female connectors 12*a* are similar to female connectors 12 in that they engage and rigidly hold male connector 11. Inverted panels 10 have a generally flat surface 10*a* to which supports 13 are connected. At the sides of surface 10*a* is located a flat face 16 at an approximate 90° angle with surface 10a. Adjacent to face 16 is return 17, which in turn forms an approximate 90° angle with face 16. Located adjacent return 17 is first inner face 16a which forms an approximate 90° angle with return 17. Located adjacent first inner face 16*a* is second return 17*a* which forms an approximate 90° angle with first inner face 16*a*. Located adjacent second return 17*a* is second inner face 16*b* which is approximately parallel to outer face 16. Second inner face 16b has male connector 11 connected thereto for receipt within female connector 12*a* aligned therewith, as shown in FIG. 1. Both ends of inverted wall panels 10 have similar faces and returns as 16, 16*a*, 16*b*, 17 and 17*a*, with the exception that one second inner face 16*b* has a male connector 11 attached thereto and the other second inner face 16*a* has a female connector 12*a* connected thereto.

In FIG. 1A is shown an inverted wall assembly generally indicated by the numeral 15. Inverted wall assemblies include two inverted wall panels 10 which have been forced together thereby causing female connector 12 to engage and hold male connector 11.

In FIG. 2 is shown two everted panels generally indicated by the numeral 20, aligned for assembly. Both panels are identical, but one panel has been turned 180° relative to the other panel so that the panels may be clipped together. The panels are held together by male connectors 11 and female connectors 12 mounted on supports 13. The number of supports 13 required is optional and may vary according to the width of the panel. If the panels are relatively narrow, supports 13 may be eliminated, as shown in FIG. 7. Everted panels 20 have a generally flat surface 20*a* to which supports 13 are connected. At the sides of panels 20 is located a flat outer face 21 at an approximate 90° angle with a first return 22. First return 22 is adjacent to first inner face 21a and forms an approximate 90° angle therewith. Located adjacent to first inner face 21*a* is second return 22*a* which forms an approximate 90° angle with first inner face 21*a*. Located adjacent to second return 22*a* is second inner face 21*b* which forms an approximate 90° angle with second return 22*a*. Both ends of everted wall panels 20 have similar faces and returns as 21, 21*a*, 21*b*, 22 and 22*a*, with the exception that one outer face 21 has a male connector 11 attached thereto and the other outer face 21 has a female connector 12*a* connected thereto.

In FIG. 2A is shown an everted wall assembly generally indicated by the numeral 25, which comprises two everted wall panels 20 which have been forced together thereby causing female connector 12 to engage and hold male connector 11.

In FIG. 3 is shown an end cover generally indicated by the numeral 30, for insertion into inverted wall assembly 15 to fill the channel in the end of inverted wall assembly 15 thereby forming a smooth surface, as shown in FIG. 6. End cover 30 includes a generally U-shaped channel 31 having connected at right angles thereto returns 33. Returns 33—33 have connected thereto lips 32—32. Lips 32—32 are connected to returns 33—33 at approximately right angles and are parallel to the walls of channel 31. In FIG. 3, end cover 30 is broken into two sections for purposes of illustration. In FIG. 6, end cover 30 is shown connected to and received in inverted wall assembly 15.

In FIG. 4 is shown a corner cover generally designated by the numeral 35. Corner cover 35 is used for adjoining two inverted wall section 15 to form a corner, as shown in FIGS. 5 and 7. Corner cover 35 includes two corner faces 38 connected at right angles to each other. Corner faces 38 have connected thereto at approximatey right angles returns 39—39. Returns 39—39 have connected thereto at approximately right angles braces 37—37 which are approximately parallel respectively to corner faces 38—38, respectively. Connected to braces 37—37 are locking lips 36—36 which are generally parallel to returns 39—39, and are sufficiently wide enough to engage the second inner faces **16*b*—16*b* of inverted wall assembly 15, as shown in FIG. 5.**

In FIG. 7 is shown a perspective view of two walls and a corner cover 35. The walls are composed of everted wall assembly 25 received in and connected to an inverted wall assembly 15 which is connected to corner cover 35. Corner cover 35 is also connected to another inverted wall assembly 15 which has connected to one end thereof end cover 30.

Walls and panels made in accordance with the present invention may have any desired shape or form. The panels of the present invention are preferably made from a plastic material, either a thermosetting or thermoplastic material. Such plastic panels are light in weight and, in general, flame-resistant when halogenated plastics are employed. In particular, panels made of polyvinyl chloride are highly suitable. Panels and covers made from polyvinyl chloride are light in weight and easy to cut or saw.

Walls made from the panels, panel assemblies and covers of the present invention, can be constructed without the necessity of nailing, gluing, stapling, or the like. Temporary walls can be constructed easily by snapping the components together and can be disassembled easily by unsnapping the components.

The foregoing is considered as illustrative only of the principles of the invention. Further, since numerous modifications or changes will readily occur to those skilled in the art, it is not desired to limit the invention the exact construction and operation shown and described, and accordingly all suitable modifications and equivalents may be resorted to falling within the scope of the invention as claimed.

I claim:

1. A wall means comprising an inverted snap-together panel assembly and an everted snap-together panel assembly slidably connected to each other in an end to end relationship, said inverted panel assembly comprising a pair of substantially identical inverted panel means positioned 180° relative to each other and paralleledly connected together, and said everted panel assembly comprising a pair of substantially identical everted panel means positioned 180° relative to each other and paralleledly connected together; said inverted panel assembly having an opening formed in each end thereof for slidably and lockedly receiving a projecting means on said everted panel assembly; said everted panel assembly having a projection means on each end thereof for slidably and lockedly mating with said openings in the end of said inverted panel assembly; said inverted panel means comprising a member having a generally flat exterior surface and an inverted opening forming means on each end thereof, one of said inverted opening forming means having a male connector thereon and the other of said inverted opening forming means having a female connector thereon, said male connector on said inverted opening means adapted to receive a female connector on an inverted opening forming means of another inverted panel means and said female connector on said inverted opening means adapted to be received by a male connector on an inverted opening means of said another panel means, said inverted panel means member having an even number of intermediate support members extending perpendicularly therefrom opposite the flat exterior surface thereof, and said inverted panel means member intermediate support members having alternately thereon, male and female connectors snapped-to and lockedly mated with female and male connectors, respectively, on support members on another inverted panel means member; and, said everted panel means comprising a member having a generally flat exterior surface and an everted projection forming means on each end thereof, one of said everted projection forming means having a male connector thereon and the other of said everted projection forming means having a female connector thereon, said male connector on said everted projection forming means adapted to receive a female connector on an everted projection forming means of another everted panel means and said female connector on said everted projection forming means adapted to receive a male connector on an everted projection forming means of said another everted panel means, said everted panel means member having an even number of intermediate support members extending perpendicularly therefrom opposite the flat exterior surface thereof, and said everted panel means member intermediate support members having alternately thereon, male and female connectors snapped-to and lockedly mated with female and male connectors, respectively, on support members on another everted panel means member.

2. The wall means of claim 1, wherein said inverted panel assembly has end cover means slidably connected to one end thereof.

3. The wall means of claim 1, wherein said inverted panel assembly has a corner cover means slidably connected to one end thereof.

4. An inverted snap-together panel assembly comprising a pair of substantially identical inverted panel means positioned 180° relative to each other and paralleledly connected together, said inverted panel assembly having an opening formed in each end thereof for slidably and lockedly receiving a projecting means on an end of an everted snap-together panel assembly; said inverted panel means comprising a member having a generally flat exterior surface and an inverted opening forming means on each end thereof, one of said inverted opening forming means having a male connector thereon and the other of said inverted opening forming means having a female connector thereon; said male connector on said opening forming means being mated with the female connector on the opening forming means on the member of the other of said inverted panel means, and said female connector on said opening forming means being mated with the male connector on the opening forming means on the member of said other inverted panel means, and said flat exterior surface member having an even number of intermediate support members extending perpendicularly therefrom opposite the flat exterior surface thereof, and said support members having alternately thereon, male and female connectors snapped-to and lockedly mated with female and male connectors, respectively, on support members on the flat exterior surface member of the other of said inverted panel means.

5. The inverted snap-together panel assembly of claim 4, wherein said inverted opening forming means comprises a flat outer face means extending inwardly at substantially a 90° angle from the end of said flat exterior surface member, a return means connected to said flat outer face means and extending inwardly therefrom at substantially a 90° angle, an inner face means connected to said return means and extending therefrom at substantially a 90° angle toward said flat exterior surface member, a second return means connected to said inner face means and extending inwardly therefrom at substantially a 90° angle, and a second inner face means connected to said second return means and extending therefrom at substantially a 90° angle away from said flat exterior surface member; said flat outer face means, said inner face means and said second inner face means being substantially in parallel planes with each other, and said flat exterior surface member, said return means, and said second return means being substantially in parallel planes with each other.

6. The inverted snap-together panel assembly of claim 5, wherein said male connector on said one of said inverted opening forming means extends inwardly and downwardly from the second inner face means of said one of said inverted opening forming means and said female connector on said other of said inverted opening forming means extends inwardly and downwardly from the second inner face means of said other of said inverted opening forming means.

7. An everted snap-together panel assembly comprising a pair of substantially identical everted panel means positioned 180° relative to each other and paralleledly connected together, said everted panel assembly having a projection means formed in each end thereof for slidably and lockedly mating with an opening on an end of an inverted snap-together panel assembly; said everted panel means comprising a member having a generally flat exterior surface and an everted projection forming means on each end thereof, one of said everted projection forming means having a male connector thereon and the other of said everted projection forming means having a female connector thereon; said male connector on said projection forming means being mated with the female connector on the projection forming means on the member of the other of said everted panel means; and said female connector on said projection forming means being mated with the male connector on the projection forming means on the member of said other everted panel means, and said flat exterior surface member having an even number of intermediate support members extending perpendicularly therefrom opposite the flat exterior surface thereof, and said support members having alternately thereon, male and female connectors snapped-to and lockedly mated with female and male connectors, respectively, on support members on the flat exterior surface member of the other of said everted panel means.

8. The everted snap-together panel assembly of claim 7, wherein said everted projection forming means comprises a second inner face means extending inwardly at substantially a 90° angle from the end of said flat exterior surface member, a second return means connected to said second inner face means and extending outwardly therefrom at a substantially 90° angle, a first inner face means connected to said second return means and extending therefrom at a 90° angle toward a plane on alignment with said flat exterior surface member, a first return means connected to said first inner face means and extending outwardly therefrom at substantially at 90° angle, and a flat outer face means connected to said first return means and extending therefrom at substantially a 90° angle away from said plane on alignment with said flat exterior surface member; said flat outer face means, said first inner face means and said second inner face means being substantially in parallel planes with each other; and said first return means, said second return means, and said flat exterior surface member being substantially in parallel planes with each other.

9. The everted snap-together panel assembly of claim 8, wherein said male connector on said one of said everted projection forming means extends inwardly and downwardly from the flat outer face means of said one of said everted projection forming means and said female connector on said other of said everted projection means extends inwardly and downwardly from the flat outer face means of said other of said everted projection forming means.

* * * * *